US005174782A

United States Patent [19]

Bogiel et al.

[11] Patent Number: 5,174,782

[45] Date of Patent: Dec. 29, 1992

[54] ELECTRICAL CABLE CLAMPING DEVICE WITH CABLE FOIL GROUNDING MEANS

[75] Inventors: Steven B. Bogiel, Schaumburg; Joseph D. Comerci, Elmhurst; Robert DeRoss, Naperville; Richard L. Pierce, St. Charles, all of Ill.

[73] Assignee: Molex Incorporated, Lisle, Ill.

[21] Appl. No.: 817,181

[22] Filed: Jan. 6, 1992

[51] Int. Cl.[5] ..... H01R 4/24

[52] U.S. Cl. ..... 439/404; 439/497; 439/498

[58] Field of Search ..... 174/117 F, 117 FF, 36, 174/78; 439/465, 466, 467, 492, 494, 497, 498, 499, 395, 404, 405

[56] References Cited

U.S. PATENT DOCUMENTS

| | | | |
|---|---|---|---|
| 3,934,075 | 1/1976 | Dilliplane | 174/36 |
| 4,068,912 | 1/1978 | Hudson, Jr. et al. | 339/99 R |
| 4,492,815 | 1/1985 | Maros | 174/36 |
| 4,500,157 | 2/1985 | Huffnagle et al. | 339/97 R |
| 4,678,864 | 7/1987 | Cox | 174/36 |
| 4,973,264 | 11/1990 | Kamono et al. | 439/498 |
| 4,997,388 | 3/1991 | Dale et al. | 439/404 |
| 5,038,001 | 8/1991 | Koegel et al. | 439/498 |

*Primary Examiner*—David L. Pirlot
*Attorney, Agent, or Firm*—Stephen Z. Weiss

[57] ABSTRACT

A cable clamping device is provided for use with an electrical connector for electrically terminating conductors of a multi-conductor cable. The cable includes a shielding foil running the length of the cable. The cable clamping device includes first and second clamp means hingedly attached and defining mating faces profiled to provide a cable passage therebetween. Complementary interengaging latch means are provided on the first and second clamp means to hold the clamp means together sandwiching the cable in the passage. A foil shield bus terminal is mounted on one of the first and second clamp means and includes puncture means for penetrating the shielding foil. The other first and second clamp mans bias the shielding foil into penetrating engagement with the puncture means. A conductive means couples the foil shield bus terminal to the ground conductor of the cable.

14 Claims, 3 Drawing Sheets

ELECTRICAL CABLE CLAMPING DEVICE WITH CABLE FOIL GROUNDING MEANS

FIELD OF THE INVENTION

This invention generally relates to the art of electrical connectors and, particularly, to a cable clamping device for use with an electrical connector for electrically terminating conductors of a multi-conductor cable and to ground a shielding foil of the cable.

BACKGROUND OF THE INVENTION

Electrical connector assemblies are available for multi-conductor cables and which include an elongated housing having a cable terminating face. The housing has a plurality of contacts or terminals therein, the contacts having respective conductor receiving portions extending from the face, such as insulation displacement conductor terminating portions. The connector assembly also may include an elongated cable clamping cover assembly having latch means engaging complementary latch means on the housing to retain the cover assembly against the cable terminating face of the housing. The cover assembly has a through passage for receiving the conductors and aperture means which receive the conductor receiving portions of the contacts. Such connector assemblies are used, for example, in a communication system wherein it may be desirable to tap a peripheral device into the cable of an existing system. An example of such an electrical connector assembly is shown in U.S. Pat. No. 4,668,039 to Marzili, dated May 26, 1987.

There are certain cable configurations in power and data transmission systems wherein a multi-conductor flat cable is rolled into a generally cylindrical configuration and surrounded by a generally tubular shielding foil running the length of the cable. The foil, in turn, is enclosed within an outer tubular covering or insulating cladding of the cable. While there are a variety of connector assemblies and cable clamping devices for multi-conductor flat cables in the prior art, as described above, such foil-shielded cables present problems where it is desirable to couple the shielding foil back to a ground conductor of the multi-conductor cable. This is particularly true in environments where emissions problems are prevalent. The cable is going to emit a certain amount of radiation. Consequently, if at all possible, it would be desirable to couple the shielding foil back to an earth ground to provide a much "cleaner" shield.

This invention is directed to providing an electrical connector assembly which includes a cable clamping cover assembly or device for facilitating enhanced grounding of a shielding foil.

SUMMARY OF THE INVENTION

An object, therefore, of the invention is to provide a new and improved electrical cable clamping device for use in an electrical connector assembly and which includes a novel clamping and grounding means for a shielding foil of the cable.

Generally, in the exemplary embodiment of the invention, a cable clamping device is disclosed for use with an electrical connector for electrically terminating conductors of a multi-conductor cable. The cable includes a ground conductor and a shielding foil running the length of the cable. The cable clamping device includes at least a pair of clamp members hingedly attached and defining mating faces profiled to provide a cable passage therebetween, and complementary interengaging latch means on the clamp members hold the members together sandwiching the cable in the passage.

The invention contemplates that a foil shield bus terminal be provided on one of the clamp members and including puncture means for penetrating the shielding foil. Means are provided on the other of the clamp members for biasing the shielding foil into penetrating engagement with the puncture means. Conductive means are provided for coupling the foil shield bus terminal to the ground conductor of the cable. As disclosed herein, the other of the clamp members is a "split member" providing a pair of clamping portions. One clamping portion is hingedly attached along one side of the one clamp member for clamping the conductors of the cable therebetween, and the other clamping portion is hingedly attached to the one clamp member along an opposite thereof for biasing the shielding foil into penetrating engagement with the puncture means.

Preferably, the entire cable clamping device is unitarily molded of dielectric material such as plastic or the like, and the two clamping portions are hingedly attached to the one clamp member by integral "living" hinges.

The puncture means on the foil shield bus terminal are provided in the form of serrated teeth, and the means for biasing the shielding foil into penetrating engagement with the puncture means is provided in the form of a recessed area in the other clamp member for receiving the serrated teeth.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
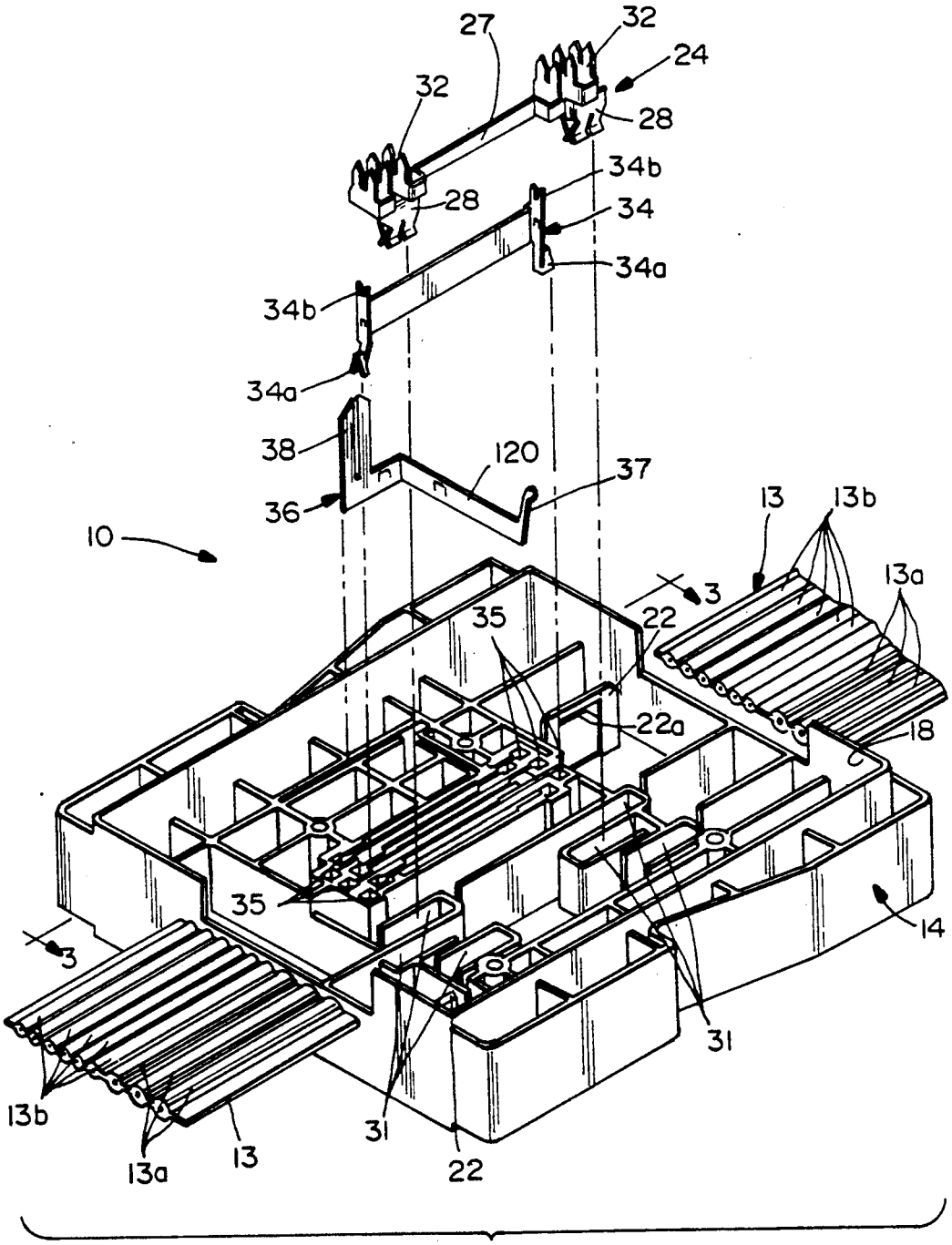
FIG. 1 is an exploded perspective view of the rear and terminating side of an electrical connector to which the cable clamping device of the invention can be assembled, in conjunction with a multi-conductor flat cable.
Figure 2:
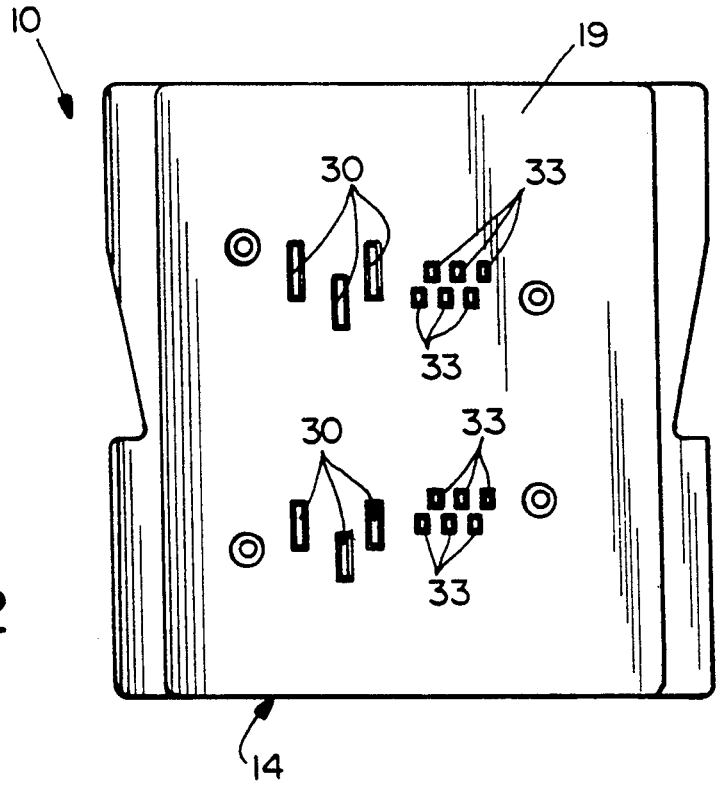
FIG. 2 is a front elevational view of the electrical connector of FIG. 1.
Figure 3:
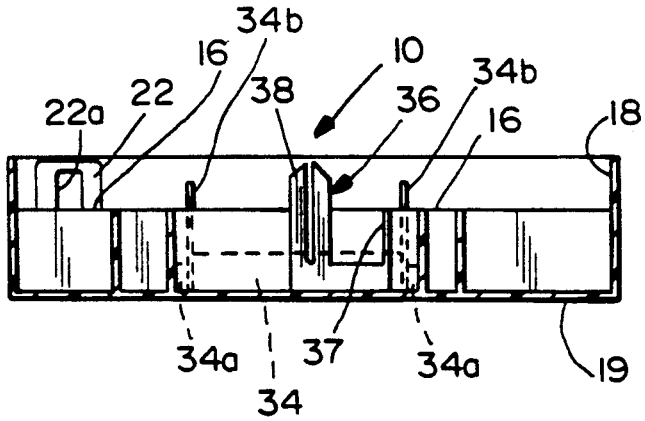
FIG. 3 is a section taken generally along line 3—3 of FIG. 1.
Figure 5:
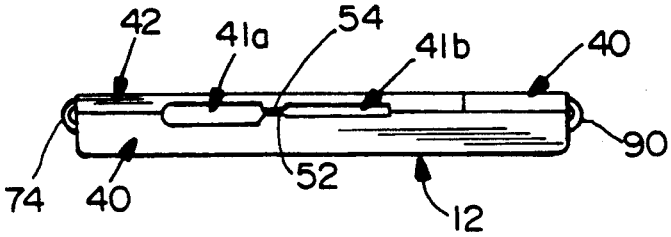
FIG. 5 is an end elevational view of the cable clamping device in its closed condition.
Figure 4:
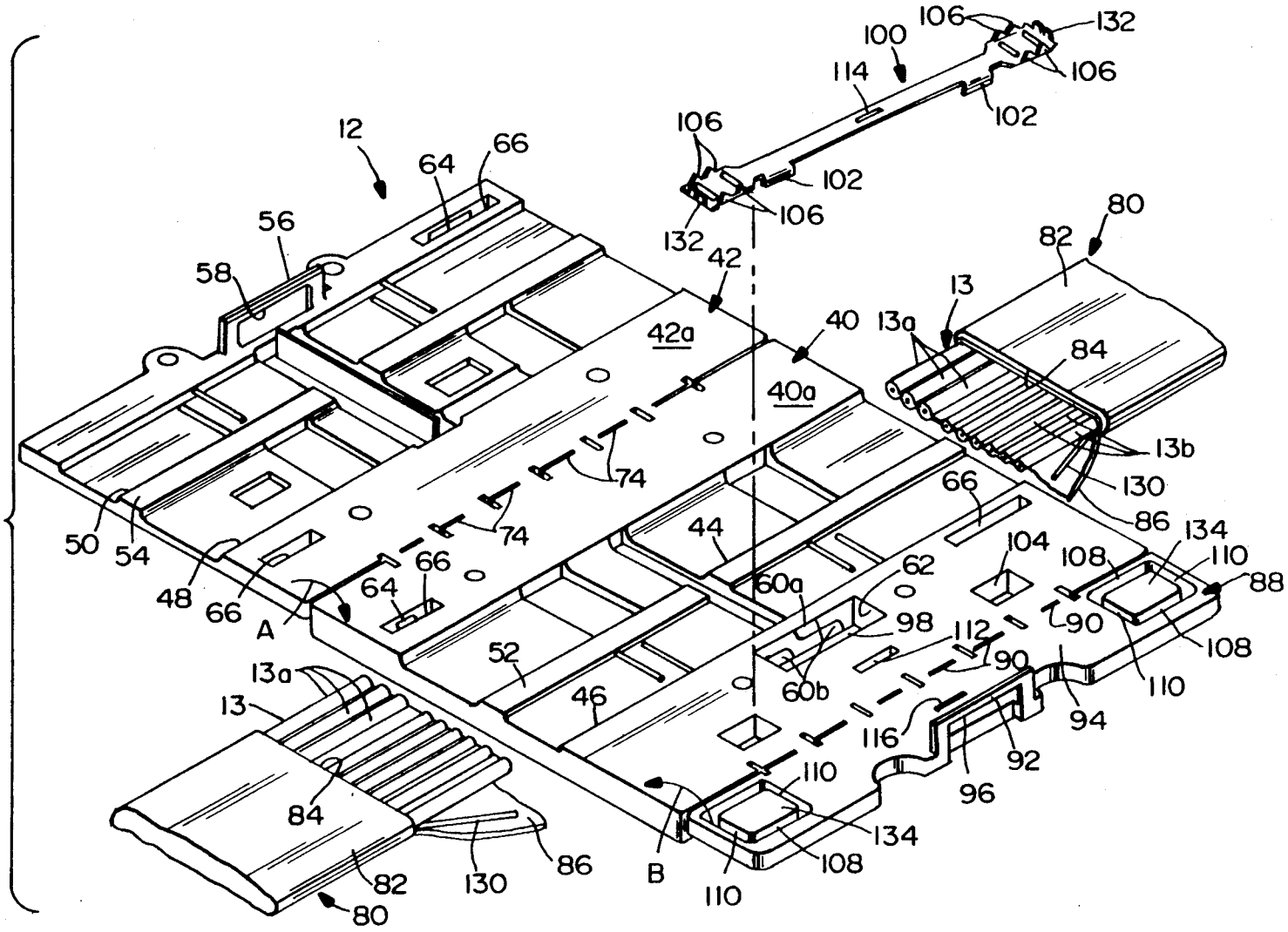
FIG. 4 is a perspective view of the cable clamping device of the invention, with the foil shield bus terminal isolated therefrom to facilitate the illustration, with the device in its opened condition, and in conjunction with the shielded cable.

Referring to the drawings in greater detail, FIGS. 1–3 show an electrical connector, generally designated 10, and FIGS. 4 and 5 show a cable clamping device, generally designated 12, which when assembled together provide an electrical connector assembly for terminating conductors of a multi-conductor flat cable, generally designated 13 in FIG. 1. Multi-conductor flat cable 13 includes a plurality of generally parallel discrete conductors surrounded by insulation and joined by an insulating web, as is generally known in the art. Cable 13 is shown in phantom in the area of electrical connector 10 so as not to block a view of the connector itself. The cable includes three power conductors 13*a* (i.e. neutral, ground and hot conductors) and a plurality of data conductors 13*b*.

Turning first to FIGS. 1–3, electrical connector 10 includes a generally rectangular or square housing, generally designated 14, having a cable terminating face 16 and an opposite mating face 18. Actually, terminating face 16, as shown in FIG. 3, is recessed within sidewalls 18 of the housing to provide a recessed area for receiving cable clamping device 12. Latch arms 22, having latching apertures 22*a*, project outwardly from terminating face 16, within the recessed area of sidewalls 18, for latching the cable clamping device to the housing, as described hereinafter.

A plurality of terminals, generally designated 24, are mounted within housing 14 for insulation-displacing termination with power conductors 13*a* of cable 13. Although only one terminal 24 is shown in FIG. 1, there will be three such terminals corresponding to the three power conductors. Each terminal 24 has mating contact portions 28 at opposite ends thereof and located behind a respective pair of a plurality of openings 30 (FIG. 2) in mating face 19 for receiving complementary contacts from an appropriate mating connector. As shown, each contact portion 28 is a female receptacle for receiving a complementary pin or blade contact from the mating connector plugged into connector 10 through openings 30. The contact portions 28 are press-fit into sockets 31 in the rear terminating face of housing 14 as seen in FIG. 1. Each terminal 24 also has a terminating portion 32. As shown, the terminating portion provides an insulation displacement means for terminating a respective power conductor 13*a* of flat multi-conductor 13 by piercing the insulation of the cable, as is known in the art. The terminating portions 32 of terminals 24 project rearwardly from cable terminating face 16 of housing 14 of electrical connector 10. The electrical connector also includes a plurality of terminals, generally designated 34 (only one of which is shown in FIG. 1), which also project from cable terminating face 16 for terminating data conductors 13*b* of cable 13. Openings 33 (FIG. 2) in mating face 19 receive prongs of appropriate plug connectors for connection to female receptacle portions 34*a* of terminal means 34. The receptacle portions 34*a* are press-fit into sockets 35 in rear terminating face 16 of housing 14. Each terminal 34 also includes a terminating portion 34*b* at each opposite end thereof, projecting from terminating face 16, for terminating a respective data conductor 13*b* of cable 13 by piercing the insulation of the cable, as is known in the art.

Lastly, a "bridging" conductive member, generally designated 36, is provided for coupling a foil shield of cable 13 to a particular one of conductors 13*a* or 13*b* which comprises a ground conductor. Specifically, bridging conductive member 36 has a terminating portion 37 of the insulation displacement type for terminating the ground conductor. The bridging conductive member also has a projecting bifurcated portion 38 for purposes described hereinafter.

Referring to FIGS. 4 and 5, according to the invention, cable clamping device 12 includes a pair of clamp members, generally designated 40 and 42, which are hingedly attached and define mating faces 40*a* and 42*a*, respectively. Recessed areas 44 and 46 in mating face 40*a* of clamp member 40, and recessed areas 48 and 50 in mating face 42*a* of clamp member 42 combine, when the clamp members are closed in the direction of arrow "A" (FIG. 4), to define a cable receiving passage means 41*a* and 41*b* between the clamp members when in closed condition as shown in FIG. 5.

For instance, as alluded above, in the communications industry, a multi-conductor flat cable, such as cable 13, may include power conductors 13*a* separated transversely of the cable from data conductors 13*b*, and all of the conductors are joined by an insulating web of the cable. The data conductors would be disposed in through passage means 41*b* defined by recessed areas 46 and 50 of clamp members 40 and 42, respectively, and the power conductors would be disposed in the through passage means 41*a* defined by recessed areas 44 and 48 of clamp members 40 and 42, respectively. Recessed areas 44 and 46 of clamp member 40 are divided by a raised rib 52, and recessed areas 48 and 50 of clamp member 42 are divided by a raised rib 54, all of which is best seen in FIG. 4. When clamp members 40 and 42 are closed in the direction of arrow "A" to the closed position shown in FIG. 5, ribs 52 and 54 clamp onto the web of insulation of the multi-conductor flat cable which separates the power conductor grouping from the data conductor grouping. That is why a gap is shown between ribs 52 and 54 in FIG. 5, in order to accommodate the thickness of the web of insulating material.

Latch means are provided on clamp members 40 and 42 to hold the members together sandwiching flat cable 13 therebetween in through passages 41*a* and 41*b*. More particularly, a latch arm 56, having an elongated aperture 58, projects from clamp member 42. Latch detents 60*a* and 60*b* are located in an opening 62 in clamp member 40. The latch detents have tapered camming surfaces which will engage latch arm 56 when the clamp members are closed. It can be seen that latch detent 60*a* is closer to mating face 40*a* of clamp member 40 than are latch detents 60*b*. This allows for a preassembled condition of clamped members 40 and 42, i.e. whereby latch arm 56 first will snap behind latch detent 60*a* to slightly space the clamp members, and further latching engagement will cause the latch arm to latch behind latch detents 60*b* to fully close the clamp members.

Cable clamping device 12 also includes latch means for assembling the device to electrical connector 10 (FIGS. 1–3). More particularly, latch detents 64 are provided in openings 66 in clamp members 40 and 42 for receiving apertured latch arms 22 (FIGS. 1 and 3) of electrical connector 10.

At this point, it should be noted that cable clamping device 12 is unitarily molded of dielectric material such as plastic or the like and including latch arm 56 projecting from mating face 42*a* of clamp member 42. Therefore, the latch arm is flexible for snapping over latch detents 60*a*, 60*b* on clamp member 40. Likewise, housing 14 of electrical connector 10 is unitarily molded of dielectric material such as plastic or the like and latch arms 22 similarly are flexible for snapping over latch detents 64.

With cable clamping device 12 unitarily molded of plastic material, clamp members 40 and 42 are hingedly attached for clamping movement toward each other in the direction of arrow "A" (FIG. 4). Normally, clamp member 42 will be closed onto clamp member 40, with flat cable 13 first layed into recesses 44 and 46 of clamp member 40. With the cable clamping device being of plastic material, hinge means are provided by integral living hinge sections 74 joining the clamp members whereby the hinge sections bend as seen in FIG. 5 when the clamp members are moved from their opened condition to their closed condition.

As stated hereinbefore, there are certain configurations of multi-conductor flat cable wherein the flat cable is rolled into a generally cylindrical configuration. A generally tubular shielding foil is disposed about the rolled cable, and the cable then is surrounded by a tubular insulating covering or cladding. This presents problems when tapping into such cable configurations by generally flat cable clamping devices as disclosed herein and described above, to this point. In addition, with such cable configurations, in order to provide a very good active shield, it is desirable to couple the shielding foil back to a ground. The cable, itself, presents emissions problems in that it emits a certain amount of radiation. Therefore, the greater extent that the cable shielding means can be coupled back to an earth ground, the cleaner will be the shielding affect. To that end, and referring again to FIG. 4, multi-conductor cable 13 has been shown as part of a composite cable system, generally designated 80, which has an outer tubular insulating covering or sheath 82. The covering has been cut, as at 84, and multi-conductor cable 13 has been laid-out into a flat configuration for positioning in recessed areas 44 and 46 of clamp member 40 which define passage means 41*a* and 41*b* (FIG. 5). As can be seen, a shielding foil 86 of the cable has been separated from the multi-conductor flat cable and moved to one side thereof. The invention contemplates coupling the shielding foil to a ground conductor of the cable.

More particularly, a third clamp member 88 is hingedly attached to clamp member 40 by integral living hinge means 90 similar to hinge portions 74 between clamp members 40 and 42. Clamp member 88 is pivotable about hinge means 90 in the direction of arrow "B" from an opened position shown in FIG. 4 to a closed position as shown in FIG. 5. A flexible latch arm 92 projects from a mating face 94 of clamp member 88 and includes an aperture 96 for snapping over a chamfered latch detent 98 in opening 62 in clamp member 40, on a side of opening 62 opposite latch detents 60*a* and 60*b*. Consequently, when clamp member 88 is closed onto clamp member 40, latch arm 96 and latch detent 98 hold the clamp members in closed condition sandwiching shielding foil 86 therebetween.

A foil shield bus terminal, generally designated 100, is generally elongated and includes two pairs of depending tabs 102 for press-fitting into openings 104 in mating face 40*a* of clamp member 40. Serrations or teeth 106 project upwardly from bus terminal 100 and provide puncture means for penetrating shielding foil 86. The serrated teeth are provided at opposite ends of the bus terminal. Therefore, when clamp member 88 is closed onto clamp member 40, it is intended to drive the serrated teeth in penetrating engagement with shielding foil 86.

In order to bias the shielding foil into penetrating engagement with serrated teeth 106, a pair of generally rectangular recesses, including side portions 108 and end portions 110, are molded into mating face 94 of clamp member 88. Side portions 108 of the recesses are provided for receiving serrated teeth 106 of bus terminal 100 as mating face 94 of clamp member 88 engages the sheet-like foil. Generally, in order to ground shielding foil 86, conductive means are provided for coupling the foil, through bus terminal 100, to a ground conductor of multi-conductor cable 13.

More particularly, and referring back to FIGS. 1–3 in conjunction with FIG. 4, bridging conductive member 36 is provided for this purpose. As stated above, the bridging conductive member includes a bifurcated portion 38. This portion projects upwardly through an opening 112 in clamp member 40, through an opening 114 in bus terminal 100 and into an opening 116 in clamp member 88 when the clamp member is closed. It can be seen in FIGS. 1 and 3 that bifurcated portion 38 is pointed so that it easily can penetrate any portion of shielding foil 86 which overlies opening 114 in bus terminal 100. Regardless, bifurcated portion 38 of bridging conductive member 36 is press-fit into opening 114 in the bus terminal to establish good conductivity within the opening so that conductivity between the bridging conductive member and the foil can be established through the bus terminal, itself, and its penetrating engagement with the shielding foil by means of serrated teeth 106.

As seen best in FIG. 1, a base portion 120 of bridging conductive member 36 extends transversely from bifurcated portion 38 and terminates in terminating portion 37. The terminating portion contacts the bussing strap 27 of grounding terminal 24 and establishes conductivity with a ground conductor of the grouping of power conductors 13*a*. Alternatively, base portion 120 can extend a shorter distance transversely of housing 14 to make electrical contact with a bussing strap of grounding terminal 34. As a further alternative, the terminating portion 37 can penetrate the insulation of cable 13 and make electrical contact directly to power conductor 13*a* or data conductor 13*b*. Regardless of whether bridging conductive member 120 is terminated to a data ground conductor or a power ground conductor, the result is that shielding foil 86 is provided with an earth ground to a conductor of the cable.

It should be emphasized that the provision of two clamp members 42 and 88 hingedly attached to clamp member 40 along opposite sides thereof is a preferred embodiment of the invention which facilitates assembly of composite cable 80 within the clamping members. In other words, when the multi-conductor flat cable portion of the composite cable is unrolled into a flat configuration, it can be laid in recesses 44 and 46 of clamp member 40 and clamp member 42 can be closed to its preassembled condition by means of latch arm 56 and latch detent 60*a* before completely closing the clamp member by means of latch detents 60*b*. While the flat cable portion of the composite cable is preliminarily held by clamp members 40 and 42, shielding foil 86 then can be manipulated and positioned over bus terminal 100 and particularly over serrated teeth 106 of the bus terminal. When properly positioned, clamp member 88 then can be closed and latched onto the shielding foil to effect penetration of the foil by means of the puncturing means afforded by serrated teeth 106. However, it should be understood that the pair of clamp members 42 and 88 which are operatively associated with the single clamp member 40, can be replaced by a second single clamp member to simultaneously clamp multi-conductor flat cable 13 as well as shielding foil 86, within various concepts of the invention.

Lastly, some composite cables 80 also have a drain wire 130 running lengthwise of the cable within outer insulating covering 82. This drain wire also can be coupled to ground by means of bus terminal 100.

More particularly, a notched flange 132 is provided transversely across each opposite end of bus terminal 100. The notches in the flanges are provided for receiving the drain wire. End portions 110 of the rectangular recesses in mating face 94 of clamp member 88 are provided for receiving notched flanges 132 when clamp member 88 is closed onto clamp member 40. The flat surface of mating face 94 and an area 134 within side portions 108 and end portions 110 all facilitate penetration of the shielding foil by serrated teeth 106 and the positioning of drain wire 130 into notched flanges 132 making an electrical connection therebetween.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a cable clamping device for use with an electrical connector for electrically terminating conductors of a multi-conductor cable which includes a ground conductor and a shielding foil running the length of the cable where the ground conductor is electrically isolated from the shielding foil, wherein the cable clamping device includes first and second clamp means hingedly attached and defining mating faces profiled to provide a cable passage therebetween and complementary interengaging latch means on the first and second clamp means to hold the clamp means together sandwiching the cable in the passage, the improvement comprising a foil shield bus terminal on one of the first and second clamp means including puncture means for penetrating the shielding foil, means on the other of the first and second clamp means for biasing the shielding foil into penetrating engagement with the puncture means, and separate conductive means for coupling the foil shield bus terminal to the ground conductor of the cable.

2. In a cable clamping device as set forth in claim 1, wherein said puncture means include an array of serrated teeth on the foil shield bus terminal and recess means in the mating face of the other of the first and second clamp means aligned with the serrated teeth.

3. In a cable clamping device as set forth in claim 1, wherein said foil shield bus terminal is elongated in the longitudinal direction of the cable and includes said puncture means at longitudinally spaced locations thereon.

4. In a cable clamping device as set forth in claim 1, wherein the multi-conductor cable includes a drain wire, and said foil shield bus terminal includes means for conductive engagement with the drain wire to couple the drain wire to the ground conductor of the cable.

5. In a cable clamping device as set forth in claim 1, wherein said one of the first and second clamp means comprises a first clamp member, and the other of the first and second clamp means comprise second and third clamp members, the first and second clamp members defining said cable passage therebetween, the foil shield bus terminal being mounted on the first clamp member, and the means for biasing the shielding foil into penetrating engagement with the puncture means being located on the third clamp member.

6. In a cable clamping device as set forth in claim 5, wherein said second and third clamp members are hingedly attached to opposite sides of the first clamp member.

7. In a cable clamping device as set forth in claim 6, wherein said clamp members are unitarily molded of plastic material and are hingedly attached by integral living hinge means.

8. In a cable clamping device for use with an electrical connector for electrically terminating conductors of a multi-conductor cable which includes a ground conductor and a shielding foil running the length of the cable where the ground conductor is isolated from the shielding foil, the cable clamping device including first and second clamp means defining mating faces profiled to provide a cable passage therebetween, wherein the improvement comprises a foil shield bus terminal on one of the first and second clamp means including puncture means for penetrating the shielding foil, means on the other of the first and second clamp means for biasing the shielding foil into penetrating engagement with the puncture means, and separate conductive means for coupling the foil shield bus terminal to the conductor of the cable.

9. In a cable clamping device as set forth in claim 8, wherein said puncture means include an array of serrated teeth on the foil shield bus terminal and recess means in the mating face of the other of the first and second clamp means aligned with the serrated teeth.

10. In a cable clamping device as set forth in claim 8, wherein said foil shield bus terminal is elongated in the longitudinal direction of the cable and includes said puncture means at longitudinally spaced locations thereon.

11. In a cable clamping device as set forth in claim 8, wherein the multi-conductor cable includes a drain wire, and said foil shield bus terminal includes means for conductive engagement with the drain wire to couple the drain wire to the ground conductor of the cable.

12. In a cable clamping device as set forth in claim 11, wherein said one of the first and second clamp means comprises a first clamp member, and the other of the first and second clamp means comprise second and third clamp members, the first and second clamp members defining said cable passage therebetween, the foil shield bus terminal being mounted on the first clamp member, and the means for biasing the shielding foil into penetrating engagement with the puncture means being located on the third clamp member.

13. In a cable clamping device as set forth in claim 12, wherein said second and third clamp members are hingedly attached to opposite sides of the first clamp member.

14. In a cable clamping device as set forth in claim 13, wherein said clamp members are unitarily molded of plastic material and are hingedly attached by integral living hinge means.

* * * * *